United States Patent [19]

Levin

[11] Patent Number: 4,517,817

[45] Date of Patent: May 21, 1985

[54] METHOD AND SETTING FOR MOUNTING ORNAMENTAL BEADS AND GEMS

[76] Inventor: Ed Levin, R.D. 1, Cambridge, N.Y. 12816

[21] Appl. No.: 464,404

[22] Filed: Feb. 7, 1983

[51] Int. Cl.[3] ..... A44C 17/02; A44C 17/04

[52] U.S. Cl. ..... 63/26; 29/160.6; 29/433

[58] Field of Search ..... 63/2, 26, 28, 29 R; 29/10, 160.6, 433

[56] References Cited

U.S. PATENT DOCUMENTS

| | | | |
|---|---|---|---|
| 1,728,266 | 9/1929 | Fassnacht | 63/26 |
| 2,126,968 | 8/1938 | Mohel | 63/2 |
| 3,307,375 | 3/1967 | Estrin et al. | 63/29 R X |

*Primary Examiner*—F. Barry Shay

*Attorney, Agent, or Firm*—Kirschstein, Kirschstein, Ottinger & Israel

[57] ABSTRACT

A method and setting for mounting ornamental beads and gems which avoids the use of claws. The setting is comprised of a flat planar sheet metal support with an aperture therein and a rectilinear strip that extends diametrically across the aperture. The strip has two ends, both of which are initially in one piece with the support. In keeping with the method of this invention, one of said ends of the strip is sheared from the support adjacent a side of the aperture. The strip is then deformable about its non-sheared end from a position coplanar with the aperture thereby enabling the threading of an ornamental bead or gem with a straight-through opening therein onto said strip. Subsequent to threading of the ornament on the strip, the strip is positioned in the plane of the aperture and is held in this position by frictional wedging of the sheared end of the strip against the portion of the support from which that end has been sheared.

8 Claims, 9 Drawing Figures

METHOD AND SETTING FOR MOUNTING ORNAMENTAL BEADS AND GEMS

BACKGROUND OF THE INVENTION

1. Field of the Invention

The invention relates to a method and setting for mounting ornamental beads and gems without claws or the like.

2. Description of the Prior Art

Many pieces of jewelry and other types of decorative objects include mounted ornamental beads and gems. In order to insure the physical integrity of these deocrative objects, it is necessary to fasten the bead or gem to the body of the object.

One means of securing the bead or gem to the object, heretofore utilized, was claws. These had numerous drawbacks including possible loss of the bead or gem and interference with their display.

U.S. Pat. No. 1,728,266 discloses a setting and method for affixing gems to an ornamental chain which does not use claws. The setting and method employ two aligned opposed bars which are inserted into a hole in the gem or bead from opposite ends thereof.

Although the method of '266 was an improvement over claws, it was not without drawbacks. The need for introducing two bars into the gem from opposite ends was time consuming, hence raising the cost of producing the decorative object. Additionally, the two bars had to be constructed with some degree of precision if they were to be capable of holding the gem in place. A skilled worker, therefore, was needed to construct the setting which also added to the cost of the item. Further, as the bars had to frictionally engage the hole in the bead or gem, there existed the possibility that the bars would break a fragile bead or gem. In addition, the bars had to be bent quite sharply and hence were prone to breakage.

SUMMARY OF THE INVENTION

1. Objects of the Invention

It is an object of the present invention to provide a setting and method for mounting ornamental beads and gems which avoids the disadvantages of prior art settings and methods.

Another object of the invention is to provide a setting and method for mounting ornamental beads and gems which does not use claws.

Still another object of the invention is the provision of an inexpensive setting and method for mounting ornamental beads and gems.

A further object of the invention is to provide a setting and method for mounting ornamental beads and gems which will not harm said ornamental beads and gems.

Yet another object of this invention is to provide a setting and mounting for ornamental beads and gems which does not necessitate highly skilled labor.

An additional object is to provide a setting and mounting of the character described which lend themselves to automated mass production techniques.

Other objects of this invention in part will be obvious and in part will be pointed out hereinafter.

2. Brief Description of the Invention

In keeping with these objects and others which will become apparent hereinafter, one feature of the invention resides, briefly stated, in a setting for an ornamental bead or gem that utilizes a sheet metal support with an aperture therein, usually circular, and a rectilinear strip extending across the aperture, usually diametrically, the strip being in one piece with the support. The strip has two ends, one of which, a cantilever free end, is non-unitary with and is sheared from the support adjacent to a side of the aperture. The other end, a cantilever base, is unitary with the support. The strip is deformable about its cantilever base end from or to a position coplanar with the aperture.

Utilizing the afore-described setting, another feature of the invention resides in a method for mounting an ornament such as a bead or gem in the afore-described setting. The ornament to be mounted is provided with a through-bore, and the aperture in the support usually is formed to be at least about the size of the ornament. After deforming the strip about its cantilever base end from a position coplanar with the aperture, the strip is extended through the bore of the ornament. The strip with the ornament thereon is then deformed so that the strip again lies in the plane of the aperture. The free end of the strip is frictionally wedged against the adjacent side of the aperture from which it was sheared so that when the strip is thus deformed it lies in the plane of the aperture, and will stay in position to hold the ornament or bead in place either situated within the aperture or seated thereon.

In a preferred embodiment, the setting is composed of sterling silver which has been work hardened. The strip is formed while the aperture is stamped out of an original sterling silver work hardened mounting sheet.

The features which are considered novel are set forth in particular in the appended claims. The invention itself, however, both as to its construction and its method of operation together with additional objects and advantages thereof, will be best understood from the following description of a specific embodiment when read in connection with the accompanying drawings.

DETAILED DESCRIPTION OF THE PREFERRED EMBODIMENTS

Figure 1:
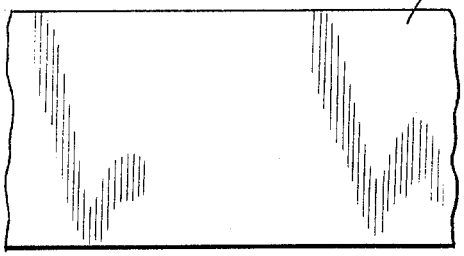
FIG. 1 is a partial top plan view of a planar support of this invention prior to an aperture being stamped therein.

Referring now in detail to the drawings, and more particularly to FIG. 1, the reference numeral 10 denotes a substantially flat planar sheet support usable to form the setting of this invention in accordance with the method thereof. The planar support is constituted of any appropriate sheet metal, either precious or common, and in a preferred embodiment the planar support is composed of sterling silver sheet having a high percentage of silver and a small percentage of copper. In accordance with an aspect of this invention, the planar support 10 has been work hardened, e.g. rolled, to impart additional strength.

Figure 2:
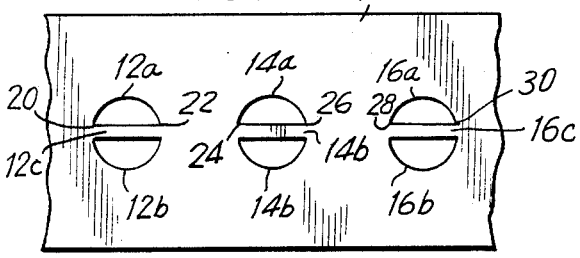
FIG. 2 is a partial top plan view of the planar support after apertures are stamped therein and with both ends of the strip unitary with the support.

In keeping with the method of this invention, as best seen in FIG. 2, the planar support 10 has formed therein a series of apertures 12, 14, 16 corresponding in number to the number of beads or gems to be set. Each aperture is composed of two opposed almost complete, usually semi-circular, open portions 12*a*, 12*b*, 14*a*, 14*b*, 16*a*, 16*b* with a rectilinear strip or bar 12*c*, 14*c*, 16*c* in diametrical orientation positioned between each pair of almost complete semi-circular open portions adjacent the corresponding long straight sides of the same.

The apertures in the support may be formed in any appropriate manner; for example, they may be stamped or punched out of the flat planar support 10 using a die or other suitable means. The apertures preferably are of a size such that the aforementioned long straight side of each semi-circular aperture portion is at least about equal to the length of the diameter of an ornament 18 if the ornament is to be fully received in the aperture. The semi-circular aperture portions and the strips are shaped, positioned and dimensioned such that when the strip has one end sheared from the support and positioned out of the plane of the aperture, as will be hereinafter explained, each aperture 12, 14 16 is generally circular in cross-section (the shape of the aperture preferably is the same as the plan configuration of the bead or gem to be mounted) and has a diameter at least about equal to the diameter of ornament 18 if the ornament is to be fully received in the aperture.

The strips 12*c*, 14*c*, 16*c* are elongated and rectilinear and extend diametrically across each generally circular aperture. Each strip 12*c*, 14*c*, 16*c* has two ends 20, 22, 24, 26, 28, 30. Because each generally circular aperture usually is formed to have a diameter at least about equal to the diameter on the ornament 18, the length of the diametric rectilinear strip also is usually at least about equal to the diameter of the ornament. It is within the scope of the invention to employ apertures and strips that are smaller than the diameter of the beads or gems, in which case, the beads or gems will seat on, rather than in, the apertures. As shown in FIG. 2, both ends of each strip are in one piece with the planar support 10 after the apertures are stamped or punched out of the support. In other words, the strips 12*c*, 14*c*, 16*c* are unstamped-out portions of the support 10 positioned between the stamped-out pairs of semicircles 12*a*, 12*b*, 14*a*, 14*b*, 16*a*, 16*b* in said support.

Figure 3:
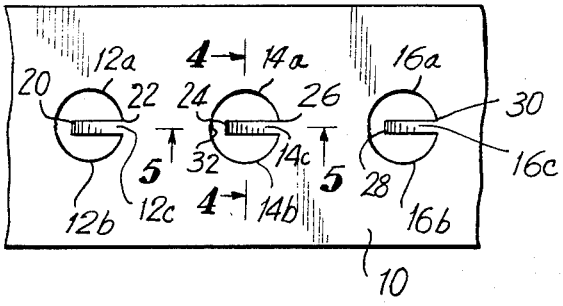
FIG. 3 is a partial top plan view of the planar support subsequent to shearing one end of the strip from the support.

Subsequent to forming the semi-circular aperture portions 12*a*, 12*b*, 14*a*, 15*b*, 16*a*, 16*b* in the planar support 10, one end of each strip is sheared from the support at a side of the aperture. Either end of each strip may be sheared, the choice of which end to shear being made by the person mounting the ornament. The strip now is cantilevered with its base cantilever end unitary with the support and its free end unconnected to the support and out of the plane thereof. As best shown in FIG. 3, free end 24 of strip 14*c* has been sheared from the support 10 adjacent the side of aperture 14. As exaggeratedly shown in the drawings, the sheared end 24 has a finely jagged or uneven peripheral edge at the zone of shearing, as does the sheared portion 32 of support 10 at the side of the aperture 14 from which the strip has been separated. End 24 and broken portion 32, due to their finely jagged peripheral edges, are capable of frictionally wedging against one another when the strip is flexed back to the plane of the aperture.

When end 24 is sheared with a die and anvil, the length of the strip 14*c* is slightly enlarged due to the compression of same between the shearing die and anvil.

Figure 4:
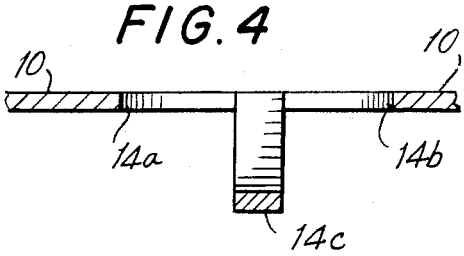
FIG. 4 is an enlarged sectional view taken substantially along the line 4—4 of FIG. 3.
Figure 5:
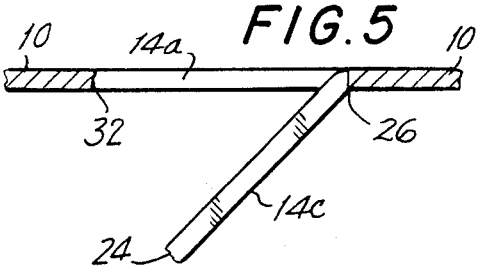
FIG. 5 is an enlarged sectional view taken substantially along the line 5—5 of FIG. 3.
Figure 8:
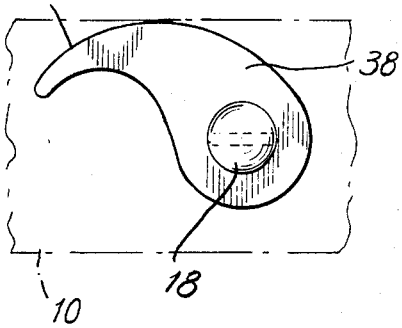
FIG. 8 is a top plan view of a portion of the support with the decorative object struck therefrom.
Figure 6:
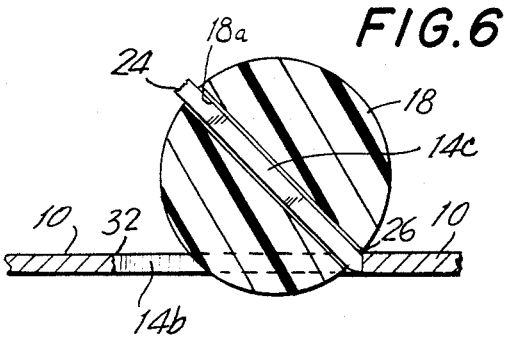
FIG. 6 is a view analogous to FIG. 5 subsequent to threading an ornament onto the strip.

The other, base, end 26 of the strip is not separated from the support but is left unitary therewith as is best shown in FIG. 6. The base end 26 provides a region about which the strip 14 may be flexed so that it is capable of lying either in the plane of the aperture as shown in FIG. 8, or out of the plane of the aperture as shown in FIGS. 4, 5 and 6. When the strip 14 is flexed to a position in which it is not coplanar with the aperture, as heretofore described, said aperture is of a generally circular cross-section.

In order to properly mount the ornament 18, it is preferable to have strip 14 as long as, or slightly longer than, the diameter of the now generally circular aperture 14. This preferred length is obtained by both the size of the apertures as stamped and the slight enlargement of the length of the strip which results, as heretofore described, from the shearing of the free end 24 from the support.

As shown in the drawings, apertures 12, 14, 16 are generally circular in cross-section after strips 12*c*, 14*c*, 16*c* are deformed so as not to be coplanar with said apertures. Although this generally circular cross-section is preferable, the apertures may be of any other appropriate shape that will permit mounting of the ornament.

The ornament 18, to be mounted on the support in accordance with the invention, has a straight-through opening 18*a* formed therein. The straight-through opening must be sufficiently large to permit the strip 14*c* to fit therethrough without damaging the ornament while preferably small enough so that the ornament will not easily rotate on the strip. The ornament itself may be any decorative bead or stone and, preferably, the ornament is of a generally spherical shape.

To mount the ornament 18 on the support, the ornament is threaded onto the strip 14*c* after shearing of the free end 24, and while the strip is positioned such that it is not coplanar with the aperture 14 or support 10, as shown in FIG. 6. Preferably, the strip is bent to an angle of about 45° to the support prior to threading the ornament thereon. The ornament is threaded onto the strip by introducing the sheared end 24 into the straight-through opening in the bead or gem and shifting said ornament until the strip lies fully within the straight-through opening. The free end 24 will extend outwardly from one side of the straight-through opening and the base end 26 will lie adjacent the other side of the straight-through opening. Because the strip is at least equal in length to the diameter of the ornament, and preferably is slightly longer than same, end 24 will always extend outwardly of the fully threaded ornament if the opening lies on a major diameter thereof. The strip should not have a length too much in excess of the diameter of the ornament to avoid problems in centering the ornament on the strip and to prevent its movement lengthwise of the strip. If the opening is not on a diameter of the ornament, the strip nevertheless will be longer than the opening but the ornament then will be seated on, rather than be fully received within, the aperture.

Figure 7:
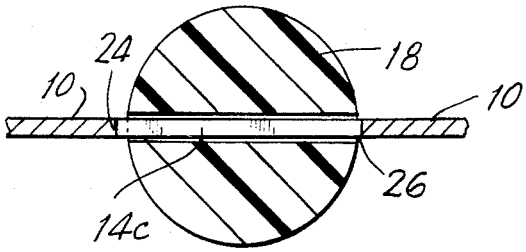
FIG. 7 is a view analogous to FIG. 6 subsequent to deforming the strip and ornament to a position in which the strip is coplanar with the aperture.

After fully threading the ornament 18 onto the strip 14*c*, the strip 14*c* is bent about its base end 26 until it is coplanar with the support and aperture 14, as shown in FIG. 7. The free end 24 must be forced back into the aperture because of the ragged edge and slight extensions in length so that it frictionally wedges against the sheared portion 32 of the support and aperture to thereby fixedly hold both strip 14*c* and the ornament 18 in place against accidental displacing force.

Although the method has been described and illustrated only for the aperture 14 and its associated elements, it is to be understood that all other apertures and associated elements formed in accordance with this invention provide an identical method for mounting an ornament.

Figure 9:
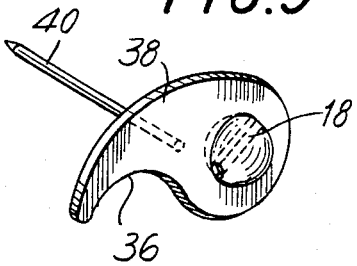
FIG. 9 is a perspective view of a completed decorative object formed in accordance with the method of this invention.

The mounted ornament is usable to form part of a jewelry piece or other decorative object. As shown in FIGS. 8 and 9, one possible use of the mounted ornament is as a component of an earring 36. To form an earring or another decorative object, an appropriate portion of the support surrounding the mounted ornament is cut from said support to constitute the setting portion 38 of the earring 36 or other decorative piece. If, as shown in the drawings, the decorative piece is to be an earring, a post portion 40 is attached to the setting 38 so that the earring may be worn inserted through a hole in a user's ear.

The planar support 10 in a preferred embodiment of the invention is a section of a mounting strip and any number of apertures may be formed therein, the number of apertures dependent upon what will ultimately be formed from the strip and/or on the number of apertures that can be conveniently and economically formed therein.

To minimize costs and labor, it is preferable to have all of the apertures on any one mounting strip of equal size.

The support 10 with its apertures 12, 14, 16 and strips 12*c*, 14*c*, 16*c* thus form a low-cost, secure, claw-free setting in which an ornamental bead or gem can be easily mounted. When used in accordance with the method of this invention, as heretofore detailed, the support, apertures and strips provide a simple yet effective method for mounting ornamental beads and gems.

Due to the fact that the frictional wedging of the sheared end 24 and sheared portion 32 against one another holds the ornament fixedly in place, there is no need for the strip to frictionally wedge against the ornament itself, thus making it unnecessary to exercise extraordinary care to avoid harming the ornament while fixing it in place in the setting.

It will be understood that each of the elements described above, or two or more together, may also find a useful application in other types of construction differing from the types described above.

While the invention has been illustrated and described as embodied in a method and setting for mounting ornamental beads and gems, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

Having described the invention, there is claimed as new and desired to be secured by Letters Patent:

1. A method for mounting an ornament in a setting which comprises:

(A) providing a planar sheet metal support;

(B) providing an ornament having a straight-through opening;

(C) forming an aperture in said support, while (D) forming a single rectilinear strip extending entirely across the aperture, both ends of said strip being in one piece with said support;

(E) shearing a single end of the strip from the support adjacent one side of the aperture while leaving the opposite end of the strip unitary with said support adjacent a different side of the aperture;

(F) flexing said strip about said opposite end from a position coplanar with the aperture;

(G) threading said strip through the straight-through opening in said ornament;

(H) bending said strip with the associated ornament back into the plane of the aperture; and (I) frictionally wedging the sheared end of the strip against the adjacent side of the aperture from which it has been sheared.

2. The method of claim 1, wherein the strip is slightly lengthened during shearing.

3. The method of claim 1 in which the support is work hardened prior to forming the aperture.

4. The method of claim 1 in which the ornament is substantially spherical and the straight-through opening extends along a diameter thereof.

5. Jewelry including

I. a setting on which on ornament with a straight-through opening is mountable, said setting comprising:

(A) a planar sheet metal support;

(B) an aperture formed in said support; and (C) a rectilinear strip with two ends, said strip extending across the aperture in said support, (i) both ends of said strip initially being in one piece with said support, (ii) a single one of said ends being sheared from said support adjacent a side of the aperture;

(D) said strip being deformable about the non-sheared end to a position non-coplanar with the aperture in said support;

II. an ornament with a through-opening threaded onto said stop while said strip is in non-coplanar position;

III. the sheared end of said strip with the ornament thereon being deformed back to a position coplanar with the aperture and with the sheared end wedged against the side of the aperture from which it was sheared before the ornament was threaded thereon.

6. The jewelry of claim 5, wherein said sheared end of the strip has a slightly jagged peripheral edge so as to be frictionally wedgable against the adjacent side of the aperture from which it has been separated.

7. The jewelry of claim 5, in which the setting is composed of sterling silver having a high percentage of pure silver and a small percentage of copper.

8. The jewelry of claim 5 in which the aperture is substantially circular and the strip extends diametrically across the aperture.

* * * * *